US008155370B2

(12) United States Patent
Hsu et al.

(10) Patent No.: US 8,155,370 B2
(45) Date of Patent: Apr. 10, 2012

(54) AUDIO SYSTEM AND A METHOD FOR DETECTING AND ADJUSTING A SOUND FIELD THEREOF

(75) Inventors: Shou-Hsiu Hsu, Taipei (TW); Kuo-Hsun Huang, Taipei (TW)

(73) Assignee: Asustek Computer Inc., Taipei (TW)

( * ) Notice: Subject to any disclaimer, the term of this patent is extended or adjusted under 35 U.S.C. 154(b) by 581 days.

(21) Appl. No.: 12/355,824

(22) Filed: Jan. 19, 2009

(65) Prior Publication Data

US 2009/0202099 A1 Aug. 13, 2009

(51) Int. Cl.

| | |
|---|---|
| ***H04R 1/02*** | (2006.01) |
| ***H04R 1/00*** | (2006.01) |
| ***H04R 25/00*** | (2006.01) |
| ***H04R 5/02*** | (2006.01) |

(52) U.S. Cl. ..... 381/387; 381/86; 381/87; 381/88; 381/89; 381/160; 381/300; 381/301; 381/302; 381/303; 381/304; 381/305; 381/306; 381/307; 381/308; 381/309; 381/310; 381/311; 381/332; 381/333; 381/334; 381/335; 381/336; 381/386

(58) Field of Classification Search ..... 381/86, 381/87, 88, 89, 160, 300, 301, 302, 303, 381/304, 305, 306, 307, 308, 309, 310, 311, 381/332, 333, 334, 335, 336, 386, 387
See application file for complete search history.

(56) References Cited

U.S. PATENT DOCUMENTS

| | | | | |
|---|---|---|---|---|
| 5,119,420 | A | 6/1992 | Kato et al. | |
| 5,199,075 | A * | 3/1993 | Fosgate | 381/307 |
| 5,264,822 | A * | 11/1993 | Vogelman et al. | 340/286.01 |
| 5,870,484 | A * | 2/1999 | Greenberger | 381/300 |
| 6,243,476 | B1 * | 6/2001 | Gardner | 381/303 |
| 6,613,005 | B1 * | 9/2003 | Friedman et al. | 601/2 |
| 6,643,377 | B1 * | 11/2003 | Takahashi et al. | 381/306 |
| 6,744,898 | B1 * | 6/2004 | Hirano | 381/333 |
| 7,043,031 | B2 | 5/2006 | Klayman et al. | |
| 7,298,853 | B2 * | 11/2007 | Norris et al. | 381/77 |
| 7,362,874 | B2 * | 4/2008 | Lee et al. | 381/307 |
| 7,386,133 | B2 * | 6/2008 | Hess et al. | 381/26 |
| 7,426,278 | B2 * | 9/2008 | Meynial | 381/82 |
| 7,483,538 | B2 * | 1/2009 | McCarty et al. | 381/77 |
| 7,519,188 | B2 * | 4/2009 | Berardi et al. | 381/104 |
| 7,529,376 | B2 * | 5/2009 | Konagai | 381/97 |
| 7,646,862 | B2 * | 1/2010 | Rodman et al. | 379/420.01 |
| 2003/0123676 | A1 * | 7/2003 | Schobben | 381/74 |
| 2005/0063555 | A1 * | 3/2005 | Berardi et al. | 381/104 |
| 2005/0281409 | A1 * | 12/2005 | Sakane et al. | 381/18 |

(Continued)

FOREIGN PATENT DOCUMENTS

| | | |
|---|---|---|
| CN | 00209903.9 | 2/2001 |

(Continued)

*Primary Examiner* — Ida M Soward
(74) *Attorney, Agent, or Firm* — Alan Kamrath; Kamrath IP Lawfirm, PA

(57) ABSTRACT

An audio system utilizes a method for detecting and adjusting a sound field effect thereof. The audio system includes a first speaker and a second speaker. The first speaker is used to emit a first sound signal, and the second speaker is used to emit a second sound signal. The method for adjusting the sound field effect includes the steps of detecting a specific position and adjusting the first speaker or the second speaker based on the specific position to focus the first sound signal and the second sound signal on the specific position.

8 Claims, 4 Drawing Sheets

U.S. PATENT DOCUMENTS

| | | | | |
|---|---|---|---|---|
| 2006/0222191 | A1* | 10/2006 | Hung et al. | 381/307 |
| 2007/0019815 | A1 | 1/2007 | Asada et al. | |
| 2007/0086596 | A1 | 4/2007 | Kino | |
| 2008/0130408 | A1* | 6/2008 | Pfaffinger | 367/13 |
| 2008/0304677 | A1* | 12/2008 | Abolfathi et al. | 381/71.1 |
| 2009/0161880 | A1* | 6/2009 | Hooley et al. | 381/17 |
| 2009/0238383 | A1* | 9/2009 | Meyer et al. | 381/182 |
| 2011/0150235 | A1* | 6/2011 | Igoe | 381/80 |

FOREIGN PATENT DOCUMENTS

| | | | | |
|---|---|---|---|---|
| CN | 01220096.4 | | | 2/2002 |
| CN | 200510046612.5 | | | 12/2006 |
| JP | 62029449 | A | * | 2/1987 |
| JP | 2005318396 | A | * | 11/2005 |

* cited by examiner

AUDIO SYSTEM AND A METHOD FOR DETECTING AND ADJUSTING A SOUND FIELD THEREOF

BACKGROUND OF THE INVENTION

1. Field of the Invention

The invention relates to an audio system and, more particularly, to an audio system capable of detecting and adjusting a sound field effect.

2. Description of the Related Art

Along with the progress of science and technology and the rising standard of living of people, as for electronic devices having an audio function, people not only require that the electronic devices can emit undistorted audio but also require that the electronic devices have the best sound field effect. Therefore, in conventional technology, each supplier of electronic devices sets a position having the best sound field effect, and then a user located at the position can obtain the best sound field effect. Each supplier of electronic devices sets the position right ahead of the electronic devices as the place having the best sound field effect.

The position of a user often is not right ahead of the audio system due to the placement position of the audio system, and therefore, the user may not obtain the best sound field effect. In conventional technology, the user only can slowly adjust the sound field position of the audio system via his hearing, and the audio system does not have an automatic adjustment method. Then, great errors may be caused.

BRIEF SUMMARY OF THE INVENTION

The objective of the invention is to provide an audio system which can detect and adjust a sound field effect.

Another objective of the invention is to provide a method for detecting and adjusting a sound field effect.

To achieve the above objective, the invention provides an audio system including a first speaker, a second speaker and a controller. The first speaker is used for emitting a first sound signal, and the second speaker is used for emitting a second sound signal. The controller is electrically connected to the first speaker and the second speaker, respectively. The controller can detect a specific position and control the first and second sound signals emitted by the first speaker and the second speaker to focus on the specific position.

The invention further provides a method for detecting and adjusting a sound field effect. The method includes the steps of detecting a specific position and adjusting the first speaker or the second speaker according to the specific position to allow the first sound signal and the second sound signal to focus on the specific position.

The best sound field position of the audio system can be randomly adjusted via the system and method of the invention.

DETAILED DESCRIPTION OF THE EMBODIMENTS

To better understand the content of the invention, a preferred embodiment of the invention is described hereinbelow.

Figure 1:
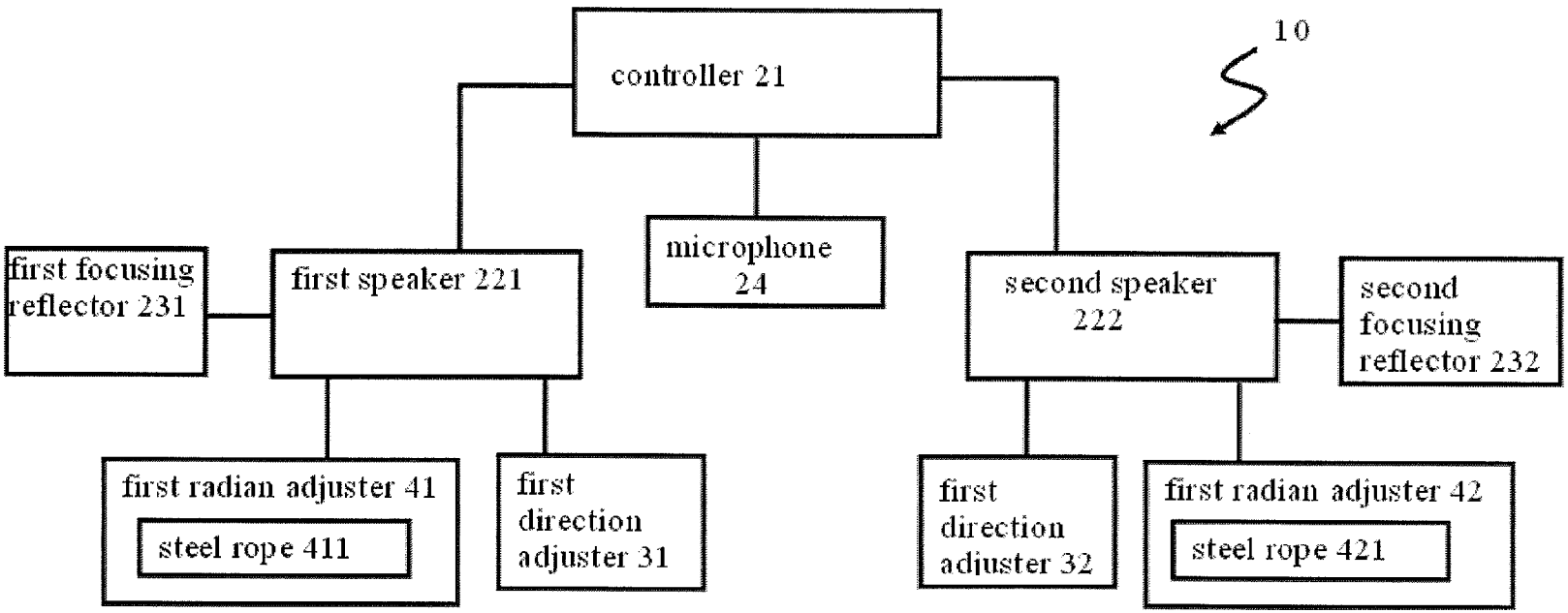
FIG. 1 is a functional block diagram showing an audio system of one embodiment of the invention.

As shown in FIG. 1, in one embodiment of the invention, an audio system 10 includes a controller 21, a first speaker 221, a second speaker 222, a first focusing reflector 231, a second focusing reflector 232, a first direction adjuster 31, a second direction adjuster 32, a first radian adjuster 41, a second radian adjuster 42, and a microphone 24.

The first speaker 221 and the second speaker 222 are electrically connected to the controller 21, respectively. In one embodiment of the invention, the first speaker 221 and the second speaker 222 can be used as the left channel and the right channel of the audio system 10 to emit a first sound signal and a second sound signal, respectively.

In the embodiment, the first focusing reflector 231 and the second focusing reflector 232 may be made of a carbon fiber material, but they are not limited in the invention. The first focusing reflector 231 and the second focusing reflector 232 are used to reflect the first sound signal emitted by the first speaker 221 and the second sound signal emitted by the second speaker 222, respectively, and focus the first sound signal and the second sound signal on a specific position.

In one embodiment of the invention, the specific position is the position where the microphone 24 is, but it is not limited in the invention. In the preferred embodiment of the invention, the microphone 24 is a receiver for receiving the first and second sound signals emitted by the first speaker 221 and the second speaker 222. In the embodiment, the microphone 24 is located at a specific position such as the position where a user is. For example, the microphone 24 is held on the user by a clamp.

After the microphone 24 receives the first sound signal and the second sound signal, it outputs at least one feedback signal to the controller 21. For example, after the microphone 24 receives the first sound signal it outputs a first feedback signal to the controller 21, and after the microphone 24 receives the second sound signal, it outputs a second feedback signal to the controller 21. In this way, the controller 21 can calculate the specific position via the first feedback signal and the second feedback signal rotate the first speaker 221 and the second speaker 222 according to the feedback signals and control the first speaker 221 and the second speaker 222 to allow the first sound signal and the second sound signal to focus on the specific position. In other embodiments, the microphone 24 also can output only one feedback signal to the controller 21, and the feedback signal may include times of receiving the first and second sound signals by the microphone 24 and other information related to the position.

Since the position where the microphone 24 is always the position where the user is, as for the audio system 10 of the preferred embodiment of the invention, the positions of the first focusing reflector 231, the second focusing reflector 232, the first speaker 221, and the second speaker 222 can be adjusted to allow the first and second sound signals emitted by the first speaker 221 and the second speaker 222 to focus on the position where the user is.

In one embodiment of the invention, the first direction adjuster 31 can be used to rotate the first speaker 221 and the first focusing reflector 231 to adjust the direction of the first sound signal. The second direction adjuster 32 can be used to rotate the second speaker 222 and the second focusing reflector 232 to adjust the direction of the second sound signal. The first radian adjuster 41 and the second radian adjuster 42 utilize steel ropes 411 and 421, respectively, to adjust the radians of the first focusing reflector 231 and the second focusing reflector 232 to adjust focusing distances.

The first direction adjuster 31, the second direction adjuster 32, the first radian adjuster 41, and the second radian adjuster 42 are electrically connected to the controller 21, and each of the adjusters may be a step motor, but they are not limited in the invention. The controller 21 can adjust the first direction adjuster 31, the second direction adjuster 32, the first radian adjuster 41, or the second radian adjuster 42 to allow the first and second sound signals emitted by the first speaker 221 and the second speaker 222 to focus on the specific position. Then, the user at the specific position can obtain the best audio effect. The method for adjusting also is described hereinbelow. The specific position may be any position in front of the audio system 10, and it is not limited in the invention.

The microphone 24 can be connected to the controller 21 in a wired or wireless mode. For example, the microphone 24 may be electrically connected to the controller 21 via a transmission wire, or the microphone 24 can wirelessly transmit data with the controller 21 via a Bluetooth device. In one embodiment of the invention, the position of the microphone 24 is the specific position where the first and second sound signals emitted by the first speaker 221 and the second speaker 222 focus. The microphone 24 is used to receive first and second test sound signals emitted by the first speaker 221 and the second speaker 222. Then, the controller 21 can detect the specific position via the microphone 24. Thus, the first and second sound signals emitted by the first speaker 221 and the second speaker 222 of the audio system 10 are adjusted to focus on the specific position. The method for detecting the specific position is described hereinbelow. The microphone 24 and the controller 21 may be connected via a wired or wireless device, but it is not limited in the invention.

Figure 2:
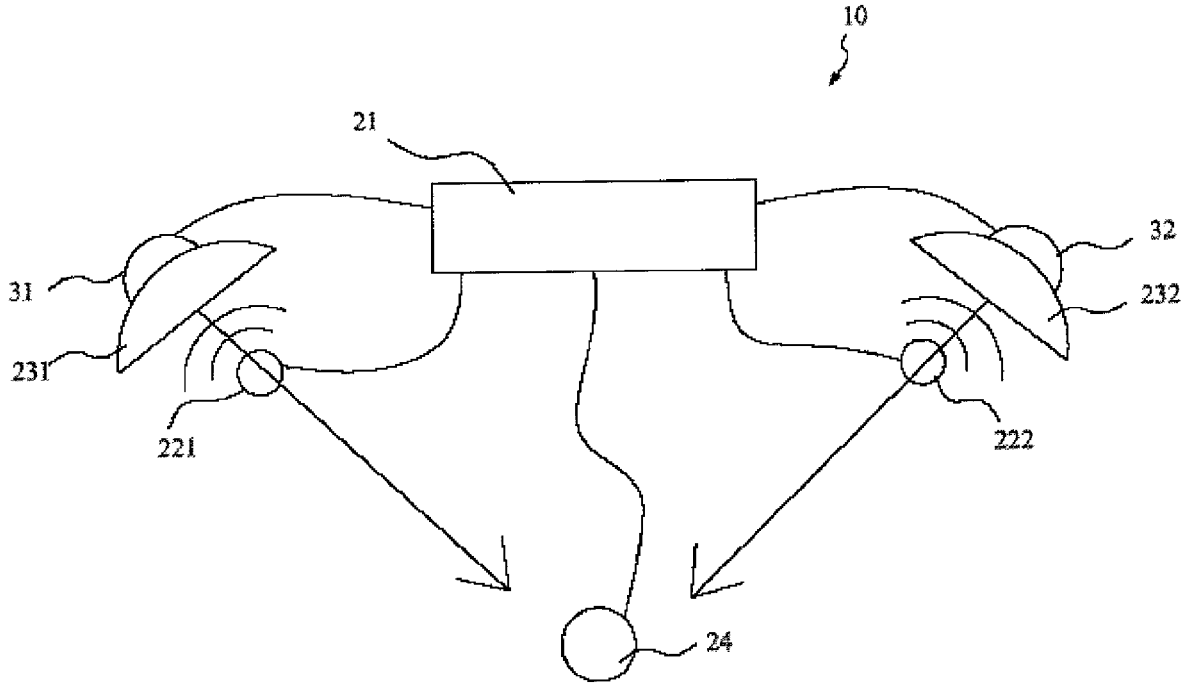
FIG. 2 is a schematic diagram showing that a rotary angle of an audio system of the preferred embodiment of the invention is adjusted.

As shown in FIG. 2, the first and second sound signals emitted by the first speaker 221 and the second speaker 222 are reflected by the first focusing reflector 231 and the second focusing reflector 232 and focus on a specific position. In FIG. 2, the specific position is the position where the microphone 24 is. The controller 21 can control the first direction adjuster 31 and the second direction adjuster 32 to adjust focusing directions, and the focusing distances are determined according to the radians of the first focusing reflector 231 and the second focusing reflector 232.

Figure 3A:
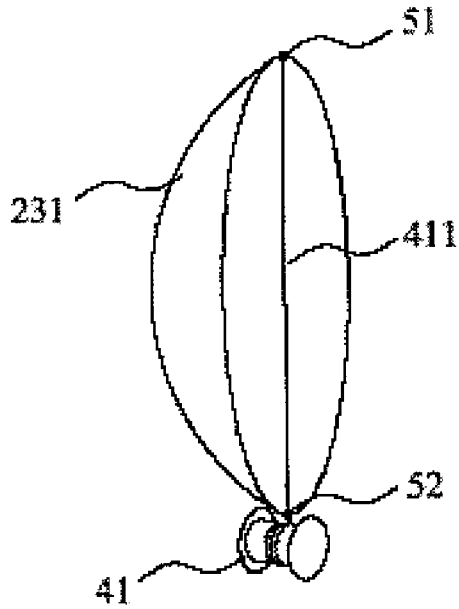
FIG. 3A and FIG. 3B are schematic diagrams showing that a reflection radian of an audio system of the preferred embodiment of the invention is adjusted.
Figure 3B:
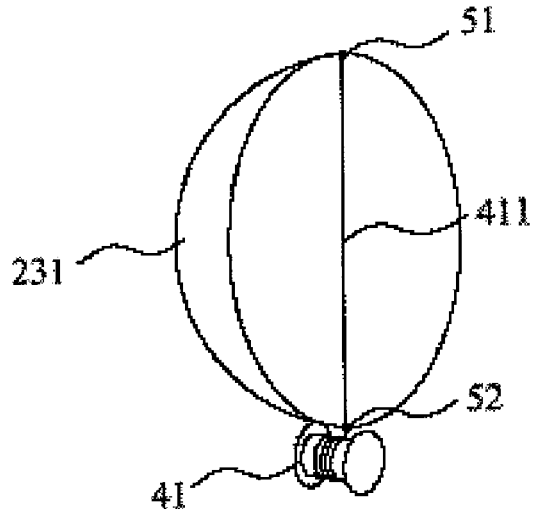

As shown in FIG. 3A and FIG. 3B, the first focusing reflector 231 is taken as an example. A steel rope 411 is disposed on the first focusing reflector 231. One end of the steel rope 411 is fixed to a first end point 51 of the first focusing reflector 231, and the other end of the steel rope 411 is wound on the first radian adjuster 41. The first radian adjuster 41 is disposed at a second end point 52 of the first focusing reflector 231. In this way, the first radian adjuster 41 can adjust the radian of the first focusing reflector 231 by changing the length of the steel rope 411 between the first end point 51 and the second end point 52.

Since the arc length of the first focusing reflector 231 is constant, when the radian of the first focusing reflector 231 is reduced, the radius of the first focusing reflector 231 is shortened. As shown in FIG. 3A, assuming that the length of the steel rope 411 between the first end point 51 and the second end point 52 is 150 centimeters and the focusing distance between the focusing point of the first focusing reflector 231 and the steel rope 411 is 121.24 centimeters, the radius and angle of the first focusing reflector 231 are calculated to be 150 centimeters and 60 degrees, respectively, via the Pythagorean theorem and the trigonometric function formula. The values of the radius and the angle substitute into the formula:

$$\text{radian}=R*2\pi\theta,$$

wherein R represents the radius of the first focusing reflector 231, and θ represents the angle. In this way, the radian of the first focusing reflector 231 is obtained.

When the focusing distance needs to be shortened, as shown in FIG. 3B, the first radian adjuster 41 is used to shorten the length of the steel rope 411 between the first end point 51 and the second end point 52. When the length of the steel rope 411 between the first end point 51 and the second end point 52 is shortened to be 140 centimeters, since the radian of the first focusing reflector 231 is constant, the value of the radian of the first focusing reflector 231 substitutes into the above formula and the following trigonometric function formula:

$$\sin\frac{\theta}{2}=\frac{\frac{L}{2}}{R},$$

wherein L represents the length of the steel rope 411 between the first end point 51 and the second end point 52. Then, the radius and angle of the first focusing reflector 231 are calculated and are 100 centimeters and 90 degrees, respectively. The focusing distance is obtained to be 70 centimeters via the Pythagorean theorem. In this way, the focusing length of the focusing reflector can be easily changed by adjusting the length of the steel rope 411 between the first end point 51 and the second end point 52.

Figure 4:
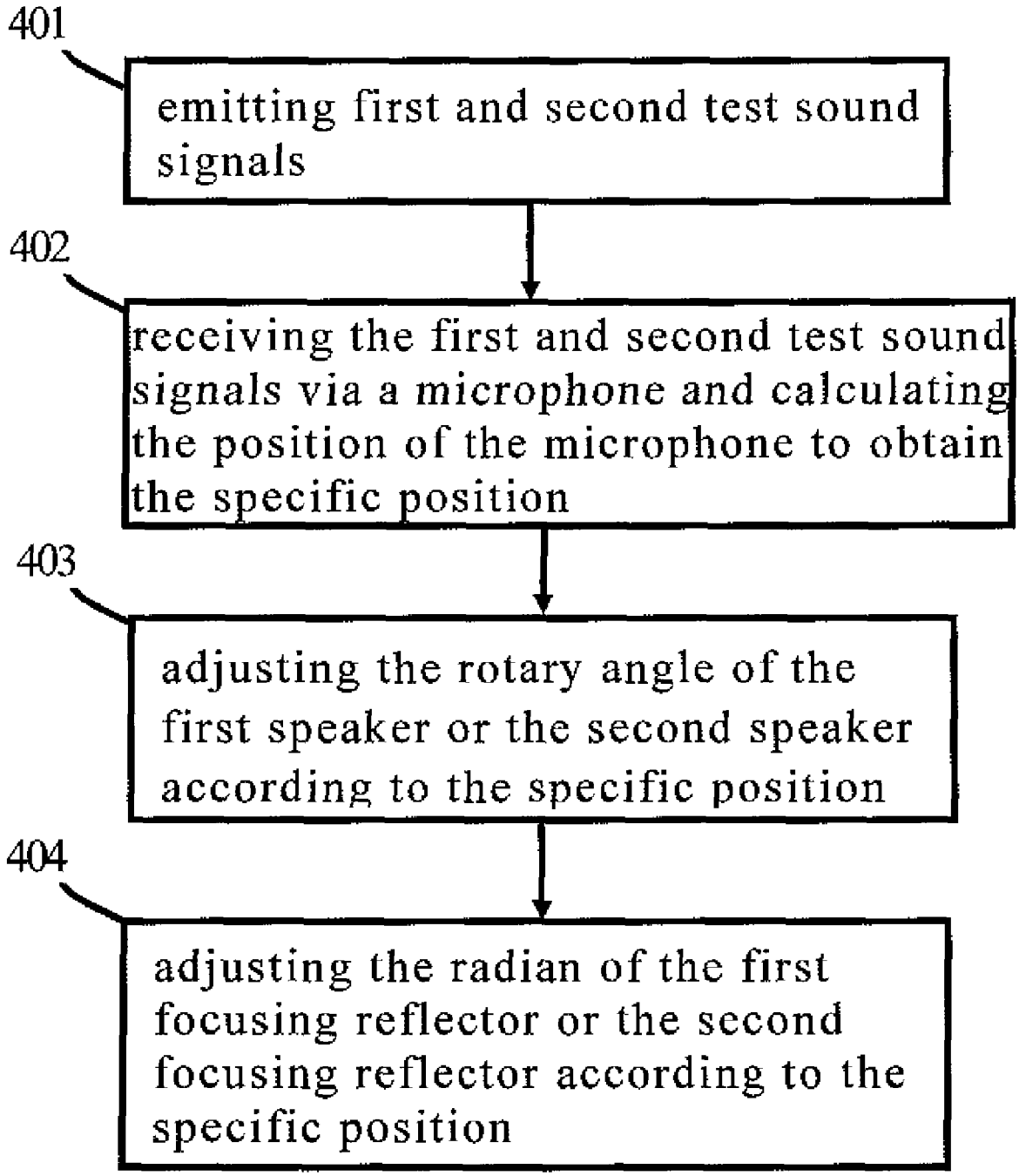
FIG. 4 is a flow chart showing a method for detecting and adjusting a sound field effect of a preferred embodiment of the invention.

As shown in FIG. 2 and FIG. 4, in the embodiment, the audio system 10 is taken as an example to illustrate the method for detecting and adjusting a sound field effect of the preferred embodiment of the invention, but the method is not limited to the audio system 10 in the invention.

First, when the sound field position of the audio system 10 needs to be adjusted, the step 401 is executed. That is, a first test sound signal and a second test sound signal are emit ted.

In the step 401, the controller 21 is used to control the first speaker 221 and the second speaker 222 to emit the first and second test sound signals, respectively, in the preferred embodiment of the invention.

Then, the step 402 is executed. That is, the microphone 24 receives the first and second test sound signals. Then, the position of the microphone 24 is calculated to obtain the specific position.

In the step 402, the first and second test sound signals emitted by the first speaker 221 and the second speaker 222 are received by the microphone 24. Then, the controller 21 can calculate the position where the microphone 24 is to obtain the specific position.

In one embodiment of the invention, the controller 21 controls the first speaker 221 to emit the first test sound signal first. The first test sound signal may be a signal of 1 KHz, but it is not limited in the invention. Next, the microphone 24 receives the first test sound signal, and the controller 21 records the received first test sound signal. Then, the controller 21 further controls the second speaker 222 to emit the second test sound signal. The microphone 24 receives the second test sound signal, and the controller 21 also records the received second test sound signal. In this way, the position where the microphone 24 is can be calculated via the volume difference of the received first and second test sound signals.

When the microphone 24 is not right ahead of the audio system 10, namely not at the best sound field position, the first and second test sound signals received by the microphone 24 have a volume difference. The controller 21 can calculate the position of the microphone 24 via the volume difference of the received first and second test sound signals.

In one embodiment of the invention, the controller 21 also can control the first speaker 221 and the second speaker 222 to emit the first test sound signal and the second test sound signal in sequence, and the microphone 24 receives the first and second test sound signals in sequence. Then, the position of the microphone 24 can be calculated via a time difference of receiving the first test sound signal and the second test sound signal.

When the microphone 24 is not located at the predetermined best sound field position of the audio system 10, the time difference between the first and second test sound signals received by the microphone 24 in sequence is different from the time difference between the first and second test sound signals emitted by the first speaker 221 and the second speaker 222 in sequence. In this way, the controller 21 can calculate the position of the microphone 24 via the difference between the time differences.

Via the above two implementing modes, the controller 21 can calculate the position of the microphone 24 to obtain the specific position. In the embodiment of the invention, the above two modes can be used at the same time. That is, the modes of calculating the position of the microphone 24 via the volume difference and the difference between the time differences are used to calculate the position of the microphone 24 to obtain a more precise calculation result.

When the specific position is obtained, the step 403 is executed. That is, the rotary angle of the first speaker or the second speaker is adjusted according to the specific position.

The controller 21 controls the first direction adjuster 31 and the second direction adjuster 32 to rotate the rotary angle of the first speaker 221 or the second speaker 222. In this way, after the sound signals emitted by the first speaker 221 and the second speaker 222 are reflected by the first focusing reflector 231 and the second focusing reflector 232, they advance toward the specific position.

The step 404 is that the radian of the first focusing reflector 231 or the second focusing reflector 232 is adjusted according to the specific position.

The controller 21 controls the first radian adjuster 41 and the second radian adjuster 42 to adjust the radian of the first focusing reflector 231 or the second focusing reflector 232 to allow the reflected sound signals to focus on the specific position.

After the controller 21 adjusts the first speaker 221, the second speaker 222, the first focusing reflector 231, or the second focusing reflector 232, test sound signals can be emitted again, and the steps 401 to 404 are repeated. The best sound field position of the audio system 10 can be confirmed to be the specific position via the repeating adjustment.

The method for detecting and adjusting the sound field effect of the invention is not limited to the above order of the steps, and the order of the above steps can be changed only if the objective of the invention can be achieved.

To sum up, these and other features, aspects, and advantages of the present invention are different from features of the conventional technology. Although the present invention has been described in considerable detail with reference to certain preferred embodiments thereof, the disclosure is not for limiting the scope of the invention.

What is claimed is:

1. An audio system comprising:

a first speaker for emitting a first sound signal;

a second speaker for emitting a second sound signal;

a receiver located at a specific position and used to receive the first sound signal and the second sound signal to generate at least one feedback signal;

a controller electrically connected to the first speaker and the second speaker, respectively;

a first focusing reflector for reflecting the first sound signal;

a second focusing reflector for reflecting the second sound signal;

a first radian adjuster for adjusting the radian of the first focusing reflector; and a second radian adjuster for adjusting the radian of the second focusing reflector, wherein the controller rotates the first speaker and the second speaker based on the at least one feedback signal to allow the first sound signal emitted by the first speaker and the second sound signal emitted by the second speaker to focus on the specific position, wherein the first sound signal and the second sound signal focus on the specific position via the first focusing reflector and the second focusing reflector, respectively, wherein the controller controls the first radian adjuster or the second radian adjuster to adjust the radian of the first focusing reflector or the second focusing reflector, respectively.

2. The audio system according to claim 1, wherein the receiver operates the controller in a wired or wireless mode.

3. The audio system according to claim 1, wherein the first radian adjuster and the second radian adjuster adjust the radians of the first focusing reflector and the second focusing reflector via steel ropes.

4. The audio system according to claim 1, wherein the first radian adjuster and the second radian adjuster are step motors.

5. The audio system according to claim 1 further comprising:

a first direction adjuster for adjusting the rotary angle of the first speaker; and a second direction adjuster for adjusting the rotary angle of the second speaker;

wherein the controller is capable of controlling the first direction adjuster or the second direction adjuster to adjust the rotary angle of the first speaker or the second speaker.

6. The audio system according to claim 5, wherein each of the first direction adjuster and the second direction adjuster is a step rotor.

7. A method for detecting and adjusting a sound field effect for an audio system comprising:

emitting a first sound signal from a first speaker;

emitting a second sound signal from a second speaker;

generating at least one feedback signal by a receiver located at a specific position and receiving the emitted first sound signal and the second sound signal;

rotating the first speaker and the second speaker based on the at least one feedback signal and controlling the first sound signal emitted by the first speaker and the second sound signal emitted by the second speaker to focus on the specific position; and adjusting a radian of a first focusing reflector or a second focusing reflector based on the at least one feedback signal to allow the first sound signal and the second sound signal to focus on the specific position, wherein adjusting the radian of the first focusing reflector or the second focusing reflector comprises:

controlling a first radian adjuster to adjust the radian of the first focusing reflector; or controlling a second radian adjuster to adjust the radian of the second focusing reflector.

8. The method according to claim 7, wherein rotating the first speaker or the second speaker comprises:

controlling a first direction adjuster to adjust a rotary angle of the first speaker; or controlling a second direction adjuster to adjust a rotary angle of the second speaker.

* * * * *